US007156341B2

(12) United States Patent
Neri

(10) Patent No.: US 7,156,341 B2
(45) Date of Patent: Jan. 2, 2007

(54) RIBBON CORE FOR UNIVERSAL MOUNTING

(75) Inventor: Joel Neri, Youngstown, NY (US)

(73) Assignee: International Imaging Materials, Inc., Amherst, NY (US)

( * ) Notice: Subject to any disclaimer, the term of this patent is extended or adjusted under 35 U.S.C. 154(b) by 50 days.

(21) Appl. No.: 10/901,182

(22) Filed: Jul. 29, 2004

(65) Prior Publication Data

US 2006/0032968 A1 Feb. 16, 2006

(51) Int. Cl.
*B65H 75/30* (2006.01)

(52) U.S. Cl. ..... 242/611.1

(58) Field of Classification Search ..... 242/611.1
See application file for complete search history.

(56) References Cited

U.S. PATENT DOCUMENTS 4,629,140 A * 12/1986 LaCasse ..... 242/611.2
4,756,488 A * 7/1988 Cooke ..... 242/608.5
4,978,240 A 12/1990 Katsuno
5,833,377 A 11/1998 Keller et al.
5,865,545 A 2/1999 Kondo
5,947,618 A 9/1999 Keller et al.
6,047,921 A * 4/2000 Liepold et al. ..... 242/610.6
6,102,326 A * 8/2000 Liepold et al. ..... 242/571.5
6,109,801 A * 8/2000 Mabit ..... 400/242
6,276,849 B1 * 8/2001 Feitel et al. ..... 400/242
6,305,638 B1 * 10/2001 Rodriguez ..... 242/599.4
6,422,770 B1 7/2002 de la Reguera
6,425,548 B1 7/2002 Christensen et al.
6,425,551 B1 7/2002 Puckett et al.
D473,262 S 4/2003 Christensen et al.
6,609,677 B1 8/2003 Seybold et al.
6,609,678 B1 8/2003 Seybold et al.
6,726,144 B1 * 4/2004 Squires ..... 242/597.6
2003/0080238 A1 5/2003 Seybold et al.
2003/0106957 A1 6/2003 Seybold et al.

* cited by examiner

*Primary Examiner*—Kathy Matecki
*Assistant Examiner*—William E. Dondero
(74) *Attorney, Agent, or Firm*—Dickstein Shapiro LLP

(57) ABSTRACT

A versatile core has a tubular body with opposing ends and includes a circumferential wall for receiving the sheet roll. A plurality of circumferentially spaced apart crush ribs project radially inward from the annular inner surface and extend axially between the ends for nesting in corresponding slots in the spindle. The crush ribs are defined by a plurality of cut outs, which are provided at each of the opposing ends and are defined by the circumferential wall. The cut outs accept and engage various configurations of ribs of a spindle assembly, with the ribs of the spindle located between the crush ribs of the core. The exterior surface of the tubular body may have a texture selected to provide the desired adhesion between the tape (attaching the sheet roll to the core) and the body surface of the cylindrical body.

3 Claims, 1 Drawing Sheet

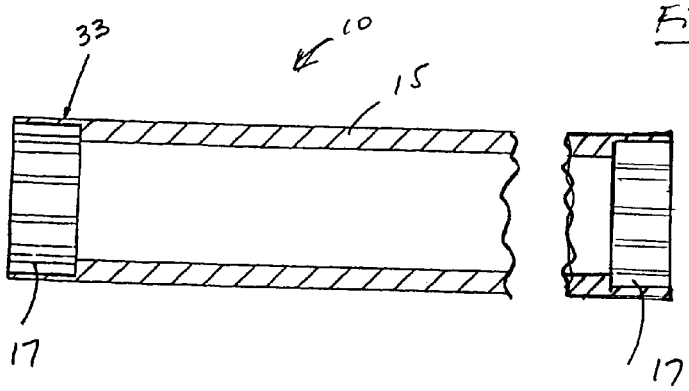
Figure 1
Figure 2
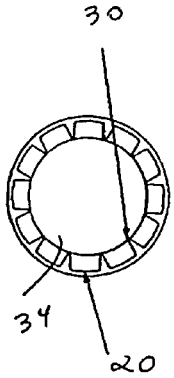
Figure 3
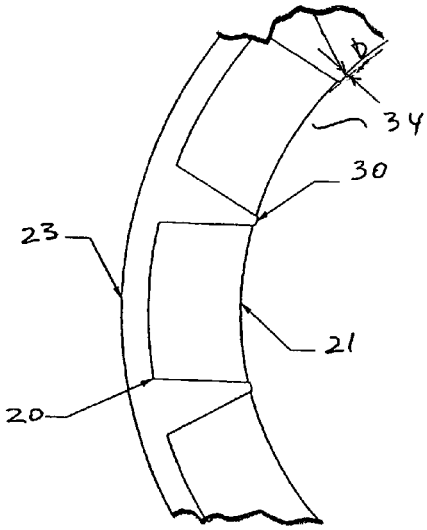

RIBBON CORE FOR UNIVERSAL MOUNTING

FIELD OF THE INVENTION

The present invention relates to printers and, more specifically, to a ribbon core for universal printers.

BACKGROUND OF THE INVENTION

Many types of printers include a roll of material that is used in the printing process. A typical example includes a roll of printing paper, upon which information may be printed. The paper is wound in a continuous sheet on a supporting core, and the core is mounted on a spindle in the printer. In another example, thermal printers utilize thermal transfer ribbon wound on a core. The thermal transfer ribbon is thermally activated during printing.

When the printing paper or ribbon is depleted, the empty core is removed from the spindle and replaced with a fully wound core, thereby returning the printer to service. The core typically includes features for accurately retaining the core on the spindle, in proper axial alignment with the printing mechanism, and in proper circumferential alignment around the spindle. Known printers that utilize cores retained on a spindle are referred to in U.S. Pat. Nos. 5,833,377; 5,947,618; 6,425,551; 6,609,677; and 6,609,678, and U.S. Patent Application Nos. 2003/0080238 and 2003/0106957, the entire disclosures of which are incorporated herein by reference.

Typically, each core with the attached ribbon is mounted on a corresponding spindle (also called "hub"). The spindle is generally cylindrical in shape and attached to a motor-operated assembly that accurately controls the rotation of the core and ribbon. Since the printer ribbons are required to be replaced, most printers that use ribbons mounted on cores must be designed such that the core containing the ribbon can be easily replaced. Accordingly, the design of the core/hub assembly must be such that aligning and inserting the core on the spindle and securing the core to the spindle are easily performed. Additionally, the interface between the spindle and a mounted core should be firm enough to keep the core with the associated ribbon attached and accurately controlled during operation of the printer. Further, the core must be desirably locked in axial position over the corresponding spindle to prevent unintended liberation or misalignment. These features increase the complexity of the core and spindle assembly, and correspondingly increase the cost. Cost is a significant factor in the manufacture and use of printer rolls, and must be minimized to maintain competitive advantage in the market of supplying replacement printing rolls.

Accordingly, it is desired to provide a simple, effective, low-cost versatile core for receiving wound sheet rolls and having corresponding retention features for mounting to various supporting spindles. The versatile core has a configuration that allows the core to accept and engage various configurations of spindle assemblies.

SUMMARY OF THE INVENTION

The present invention provides a versatile core for supporting a wound sheet roll and for being employed in conjunction with spindles having various designs and configurations.

The versatile core has a tubular body with opposing ends and includes a circumferential wall for receiving the sheet roll. An annular inner surface of the tubular body defines a bore for receiving the spindle. A plurality of circumferentially spaced apart crush ribs project radially inward from the annular inner surface and extend axially between the open ends for nesting in corresponding slots in the spindle. The crush ribs extend inward to provide lateral retention of the spindle.

The crush ribs are defined by a plurality of cut outs, which are provided at each of the opposing ends and are defined by the circumferential wall. The cut outs accept and engage various configurations of ribs of a spindle assembly, with the ribs of the spindle located between the crush ribs of the core.

The exterior surface of the tubular body may have a texture selected to provide the desired adhesion between the tape (attaching the sheet roll to the core) and the body surface of the cylindrical body. The textured outer surface also allows a starting tape to easily attach to the core and release at a proper torque level. The textured outer surface further prevents an ink ribbon from slackening or "dipping in," regardless of whether the printer is in a printing mode or not.

These and other features and advantages of the invention will be more apparent from the following detailed description that is provided in connection with the accompanying drawings that illustrate exemplary embodiments of the invention.

BRIEF DESCRIPTION OF THE DRAWINGS

FIG. 1 is a partial cross sectional view of a ribbon core according to the present invention;

FIG. 2 is an end view of the ribbon core of FIG. 1; and

FIG. 3 is an enlarged partial view of the ribbon core of FIG. 2.

DETAILED DESCRIPTION OF PREFERRED EMBODIMENTS

In the following detailed description, reference is made to the accompanying drawings, which form a part hereof, and in which is shown by way of illustration, specific embodiments in which the invention may be practiced. These embodiments are described in sufficient detail to enable those skilled in the art to practice the invention, and it is to be understood that other embodiments may be utilized, and that changes may be made without departing from the spirit and scope of the present invention.

Referring now to the drawings, where like elements are designated by like reference numerals, FIGS. 1–3 illustrate a molded ribbon core 10 shown according to a preferred embodiment of the present invention. The ribbon core 10 supports a wound sheet roll (not shown) and includes a tubular body 15 having a generally cylindrical shape and provided with open ends 17, made of molded plastic. The ribbon core 10 includes an annular outer surface defined by circumferential wall 23 for receiving the sheet roll. An annular inner surface 34 defines a bore or space for receiving the spindle (not shown).

As illustrated in FIGS. 2 and 3, a plurality of evenly spaced apart crush ribs 30 are provided at each end 17. The crush ribs 30 project radially inward from the annular inner surface 34 and extend axially between the open ends 17 for nesting in corresponding slots in the spindle. The crush ribs 30 extend inward to provide lateral retention of the spindle. As shown in FIG. 3, the crush ribs 30 have preferably a generally trapezoidal cross section and extend inward from the annular inner surface 34 by a distance "D" of about 0.5 millimeters to about 3 millimeters, more preferably about 1 millimeter.

The crush ribs 30 are defined by a plurality of cut outs 20, which are also provided at each of the opposing ends 17 and are defined by the circumferential wall 23. The cut outs 20 accept and engage various configurations of ribs of a drive hub or a spindle (not shown), with the ribs of the spindle located between the crush ribs 30 of the core 10.

In a preferred embodiment, the exterior surface of the tubular body 15 has a texture 33 selected to provide the desired adhesion between the tape (attaching the sheet roll to the core 10) and the body surface of the cylindrical body 15. The textured outer surface 33 also allows a starting tape to easily attach to the core 10 and release at a proper torque level. The textured outer surface 33 provided on the circumferential wall 23 further prevents an ink ribbon from slackening or "dipping in" at the ends 17, regardless of whether the printer is in a printing mode or not.

In a preferred embodiment of the invention, the textured outer surface 33 is formed of polyamides (such as nylon 46, nylon 66, nylon 610 or nylon 11) or polyesters (such as polyethylene terephthalate, polybutylene terephthalate or copolymers thereof), or combinations of polyamides and polyesters, provided with a rough surface with asperities of various configurations and geometries, that provide the desired adhesion between the tape and the ribbon core 10. If desired, the textured outer surface 33 may be formed of other polymeric and co-polymeric materials, or combinations of such materials, including but not limited to polystyrene, PVC (polyvinylchloride), ABS (acrylonitrile-butadiene-styrene copolymer), polyolifin (polyethylene, polypropylene, copoylmers and polymer blends), polyacrylates (polymethylmethacrylate-co-butylacrylate), polycarbonate, polyacetal, and cellulose acetate-co-buterate, among others. Optionally, the textured outer surface 33 may be provided with an adhesive film or layer that further affects how easily the ink ribbon pulls away from the core 10 and adjusts the ability of the tape to adhere to the core 10.

The ribbon core 10 described herein is constructed to receive and engage spindles having various configurations. The spindles may have radially extending members (not shown) of various shapes and configurations for operatively engaging and/or fitting between the crush ribs 30. The invention also contemplates a plurality of ribbon cores, such as the ribbon core 10 of the present invention, for receiving identical or different spindles. Thus, the present invention may be used to provide an uncomplicated injection molded ink ribbon core capable of being employed with a variety of printer spindles, including multiple different existing printer spindles. The configuration of the ribbon core 10 of the present invention avoids the problem of ink film "dipping in" where slots would have been. In addition, by using molded plastic for the ribbon core 10, slots and structural limitations imposed by a conventional cardboard core are avoided, and the surface texture is better controlled.

Although the invention has been described above with reference to a ribbon core provided with crush ribs at each of the opposing ends, such as the crush ribs 30 provided at the opposing ends 17, the invention also contemplates an embodiment according to which the crush ribs 30 are provided at only one of the ends 17 of the ribbon core. In addition, although the invention has been described above with reference to a ribbon core provided with both crush ribs and an outer textured surface, the invention is not limited to this embodiment. Accordingly, the invention also contemplates a ribbon core provided with crush ribs at one or both ends and without a textured outer surface. Alternatively, the invention also contemplates a ribbon core provided only with a textured outer surface and without crush ribs at one or both ends of the core.

Although the present invention has been described in connection with preferred embodiments, many modifications and variations will become apparent to those skilled in the art. The above description and drawings are only illustrative of preferred embodiments which can achieve and provide the objects, features and advantages of the present invention. It is not intended that the invention be limited to the embodiments shown and described in detail herein. Modifications coming within the spirit and scope of the following claims are to be considered part of the invention.

What is claimed as new and desired to be protected by Letters Patent of the United States is:

1. A core for supporting a wound sheet roll, the core comprising:

a tubular body having ends and including an outer surface for receiving a sheet roll;

an inner surface having a space for receiving a spindle, said inner surface comprising a first interior opening and a second interior opening larger than said first interior opening; and circumferentially spaced apart ribs formed at said second interior opening, said ribs projecting radially inward and extending axially for cooperating with a spindle, and wherein the spaced apart ribs project radially inward past said first interior opening by a distance from about 0.5 millimeters to about 3 millimeters.

2. A core for supporting a wound sheet roll, the core comprising:

a tubular body having ends and including an outer surface for receiving a sheet roll;

an inner surface having a space for receiving a spindle, said inner surface comprising a first interior opening and a second interior opening larger than said first interior opening; and circumferentially spaced apart ribs formed at said second interior opening, said ribs projecting radially inward and extending axially for cooperating with a spindle, and wherein the spaced apart ribs project radially inward past said first interior opening by a distance of approximately 1 millimeter.

3. The core of claim 1 or 2, wherein the spaced apart ribs are provided at the ends of the tubular body.

* * * * *